US005494225A

United States Patent [19]

Nally et al.

[11] Patent Number: 5,494,225

[45] Date of Patent: Feb. 27, 1996

[54] SHELL COMPONENT TO PROTECT INJECTOR FROM CORROSION

[75] Inventors: Debora E. Nally, Williamsburg; Bryan C. Hall; David Wieczorek, both of Newport News, all of Va.

[73] Assignee: Siemens Automotive Corporation, Auburn Hills, Mich.

[21] Appl. No.: 292,458

[22] Filed: Aug. 18, 1994

[51] Int. Cl.[6] ..... F02M 51/00

[52] U.S. Cl. ..... 239/585.5; 251/129.21

[58] Field of Search ..... 239/585.1–585.5; 251/129.21, 129.18, 129.15

[56] References Cited

U.S. PATENT DOCUMENTS 5,174,505 12/1992 Shen ..... 239/585.1 X 5,232,166 8/1993 Reiter ..... 239/585.4

5,236,174 8/1993 Vogt et al. ..... 239/585.4 X 5,307,991 5/1994 Hanson et al. ..... 239/585.5 X

*Primary Examiner*—Andres Kashnikow

*Assistant Examiner*—Lesley D. Morris

*Attorney, Agent, or Firm*—Russel C. Wells

[57] ABSTRACT

A non-metallic cylindrical shell is fitted to the exterior of a metallic valve body portion of a solenoid-operated fuel injector to cover otherwise exposed metal that exists between a lower O-ring seal proximate the nozzle and a non-metallic overmold that covers the solenoid and an adjoining portion of the valve body. The shell and the cover come together at a joint where they mutually axially overlap in such a manner that assures both coverage of the exposed metal and retention of the shell on the valve body for the full tolerance stack-up range of the various parts when assembled.

7 Claims, 2 Drawing Sheets

SHELL COMPONENT TO PROTECT INJECTOR FROM CORROSION

FIELD OF THE INVENTION

This invention relates to electrically operated fuel injectors that are used in fuel injection systems of internal combustion engines.

BACKGROUND AND SUMMARY OF THE INVENTION

Typical requirements for a fuel injector require that it be able to withstand numerous hours of corrosive salt spray environment and still display no unsightly visible signs, such as rusting of exposed metal. Past anti-rust measures have included plating the exterior of metal parts of the injector, painting the exterior, or utilizing stainless steel metal.

Plating and painting require careful process control to insure that an even thickness of plating/painting occurs only in the areas desired: surface preparation and cleanliness can be a concern, and uneven covering of the surface results in failure to protect from corrosion. If the plating is applied prior to assembly of subcomponents, contamination of the interior of the injector can result in failed durability or leaking units. Plating or painting after subassembly means subjecting the final calibrated and flowed injector to mishandling or contamination issues which could also result in failed units. Additionally, one area of an injector where it is typically difficult to insure corrosion protection is the mating area between the power group and the valve group.

Although the plating or painting does not involve adding an additional separate "component," this is an extra process, typically requiring expertise in chemical mixing or adhesion. The extra steps of routing, and the associated cost of utilizing specialists can be expensive. Furthermore, continued emphasis on environmental issues involving recycling of old products has made several of the more proven plating solutions unavailable for future use.

Utilizing stainless steel for exterior injector components is another traditional solution for enhancing corrosion protection, but stainless carries drawbacks in that tool wear and material cost can be prohibitive.

The present invention relates to a low cost, snap- or press-on plastic shell component to provide the corrosion protection for the lower end of the fuel injector. Due to the structural embodiment of the concept, the shell can successfully cover varying amounts of exposed steel that tend to be present with any component stack-up situation.

Various features, advantages and the inventive aspects will be seen in the ensuing description and claims which are accompanied by drawings that disclose a presently preferred exemplary embodiment of the invention according to the best mode contemplated at the present time for carrying out the invention.

DESCRIPTION OF THE PREFERRED EMBODIMENT

Figure 1:
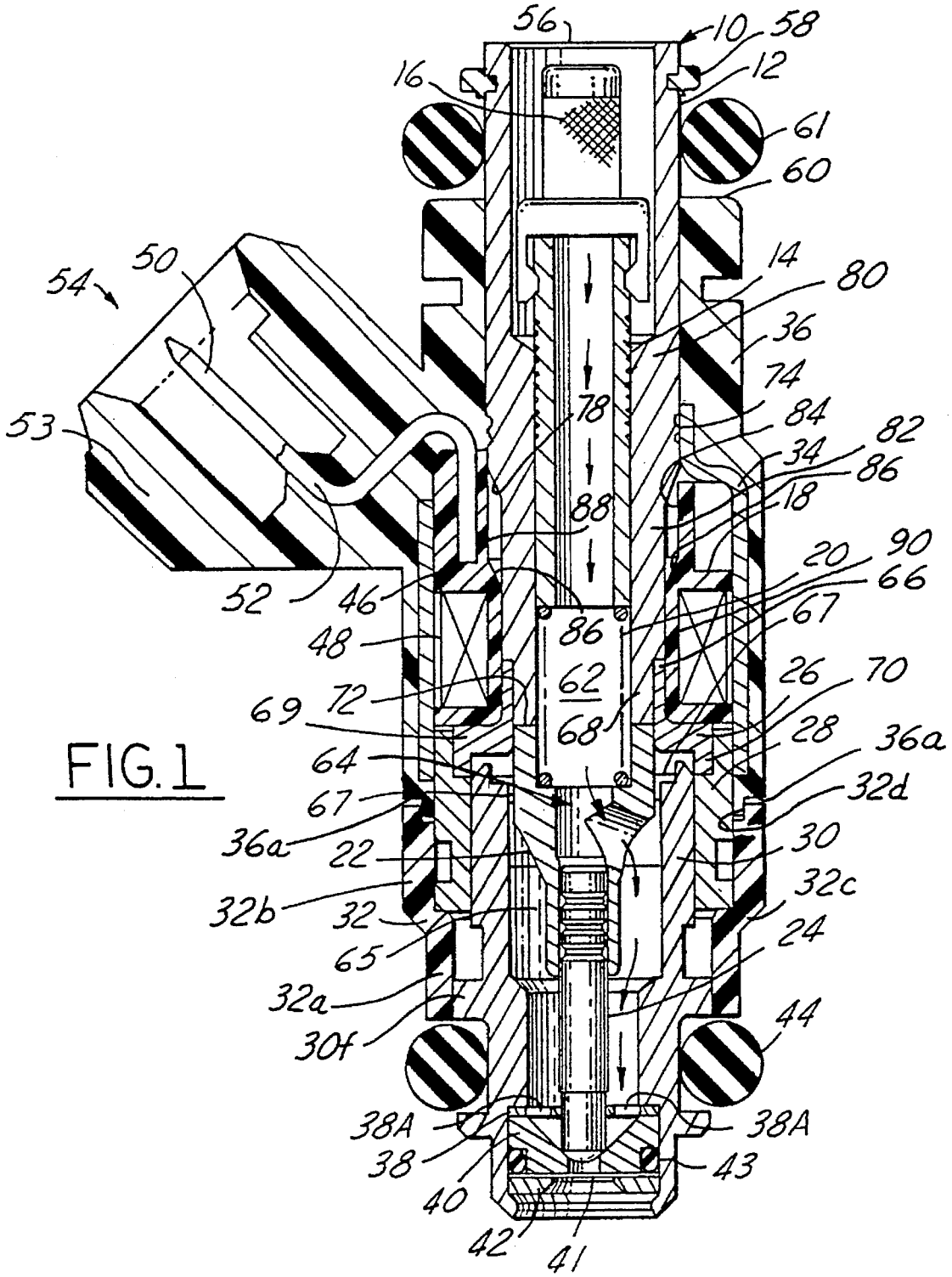
FIG. 1 is a longitudinal cross-sectional view through an exemplary fuel injector embodying principles of the present invention.

FIG. 1 shows an exemplary fuel injector 10 comprising a number of parts including a fuel inlet tube 12, an adjustment tube 14, a filter assembly 16, a coil assembly 18, a coil spring 20, an armature 22, a needle valve 24, a non-magnetic shell 26, a valve body shell 28, a valve body 30, a plastic shell 32, a coil assembly housing 34, a non-metallic cover 36, a needle guide member 38, a valve seat member 40, a thin disk orifice member 41, a backup retainer member 42, a small O-ring seal 43, and a large O-ring seal 44.

The needle guide member 38, the valve seat member 40, the thin disk orifice member 41, the backup retainer member 42 and the small O-ring seal 43 form a stack that is disposed at the nozzle end of fuel injector 10, as shown in a number of commonly assigned patents, such as U.S. Pat. No. 5,174,505. Armature 22 and needle valve 24 are joined together to form an armature/needle valve assembly. Coil assembly 18 comprises a plastic bobbin 46 on which an electromagnetic coil 48 is wound. Respective terminations of coil 48 connect to respective terminals 50, 52 that are shaped and, in cooperation with a surround 53 formed as an integral part of cover 36, to form an electrical connector 54 for connecting the fuel injector to an electronic control circuit (not shown) that operates the fuel injector.

Fuel inlet tube 12 is ferromagnetic and comprises a fuel inlet opening 56 at the exposed upper end. A ring 58 that is disposed around the outside of fuel inlet tube 12 just below fuel inlet opening 56 cooperates with an end surface 60 of cover 36 and the intervening O.D. of tube 12 to form a groove for an O-ring seal 61 that is typically used to seal the fuel injector inlet to a cup, or socket, in an associated fuel rail (not shown). The lower O-ring 44 is for providing a fluid-tight seal with a port in an engine induction intake system (not shown) when the fuel injector is installed on an engine. Filter assembly 16 is fitted to the open upper end of adjustment tube 14 to filter any particulate material larger than a certain size from fuel entering through inlet opening 56 before the fuel enters adjustment tube 14.

In the calibrated fuel injector, adjustment tube 14 has been positioned axially to an axial location within fuel inlet tube 12 that compresses spring 20 to a desired bias force that urges the armature/needle valve such that the rounded tip end of needle valve 24 is seated on valve seat member 40 to close the central hole through the valve seat. Preferably, tubes 14 and 12 are crimped together to maintain their relative axial positioning after adjustment calibration has been performed.

After passing through adjustment tube 14, fuel enters a space 62 that is cooperatively defined by confronting ends of inlet tube 12 and armature 22 and that contains spring 20. Armature 22 comprises a passageway 64 that communicates space 62 with a passageway 65 in valve body 30, and guide member 38 contains fuel passage holes 38A. This allows fuel to flow from space 62 through passageways 64, 65 to valve seat member 40. This fuel flow path is indicated by the succession of arrows in FIG. 1.

Non-ferromagnetic shell 26 is telescopically fitted on and joined to the lower end of inlet tube 12, as by a hermetic laser weld. Shell 26 has a tubular neck 66 that telescopes over a tubular neck 68 at the lower end of fuel inlet tube 12. Shell 26 also has a shoulder 69 that extends radially outwardly from neck 66. Shoulder 69 itself has a short circular rim 70 at its outer margin extending axially toward the nozzle end of the injector. Valve body shell 28 is ferromagnetic and is joined in fluid-tight manner to non-ferromagnetic shell 26, preferably also by a hermetic laser weld.

The upper end of valve body 30 fits closely inside the lower end of valve body shell 28 and these two parts are joined together in fluid-tight manner, preferably by laser welding. Armature 22 is guided by the inside wall of valve body 30 for axial reciprocation, specifically on the I.D. of an eyelet 67 that is attached to the upper end of valve body 30. Further axial guidance of the armature/needle valve assembly is provided by a central guide hole in member 38 through which needle valve 24 passes.

In the closed position shown in FIG. 1, a small working gap 72 exists between the annular end face of neck 68 of fuel inlet tube 12 and the confronting annular end face of armature 22. Coil housing 34 and tube 12 are in contact at 74 and constitute a stator structure that is associated with coil assembly 18. Non-ferromagnetic shell 26 assures that when coil 48 is energized, the magnetic flux will follow a path that includes armature 22. Starting at the lower axial end of housing 34, where it is joined with valve body shell 28 by a hermetic laser weld, the magnetic circuit extends through valve body shell 28, valve body 30 and eyelet 67 to armature 22, and from armature 22 across working gap 72 to inlet tube 12, and back to housing 34. When coil 48 is energized, the spring force on armature 22 is overcome and the armature is attracted toward inlet tube 12 reducing working gap 72. This unseats needle valve 24 from seat member 40 open the fuel injector so fuel is now injected from the injector's nozzle. When the coil ceases to be energized, spring 20 pushes the armature/needle valve closed on seat member 40.

Fuel inlet tube 12 is shown to comprise a frustoconical shoulder 78 that divides its O.D. into a larger diameter portion 80 and a smaller diameter portion 82. Bobbin 46 comprises a central through-hole 84 that has a frustoconical shoulder 86 that divides the through-hole into a larger diameter portion 88 and a smaller diameter portion 90. Shoulder 86 has a frustoconical shape complementary to that of shoulder 78.

FIG. 1 shows shoulders 78 and 86 to be axially spaced apart, and it also shows a portion of through-hole 84 and a portion of the O.D. of fuel inlet tube 12 to be mutually axially overlapping. That overlapping portion of through-hole 84 consists of shoulder 86 and a portion of the larger diameter portion 88 of the through-hole immediately above shoulder 86. That overlapping portion of the O.D. of tube 12 consists of shoulder 78 and a portion of the smaller diameter portion 82 of the tube. The significance of this concerns steps in the process of assembling coil assembly 18, fuel inlet tube 12, and shells 26 and 28, as disclosed in the commonly assigned patent application having U.S. Ser. No. 08/292,456 of Bryan C. Hall, "Coil for Small Diameter Welded Fuel Injector", filed on the same date. Reference may be had to that disclosure if the reader desires further details of that invention.

The present invention concerns plastic shell 32 and its relationship to other parts of fuel injector 10. The embodiment illustrated in FIG. 1 shows shell 32 to be of stepped cylindrical shape, comprising a smaller diameter lower axial section **32*a*, a larger diameter upper axial section 32*b*, and a step 32*c* joining sections 32*a* and 32*b*. Lower section 32*a* has circular inside and outside diameters providing a uniform radial wall thickness. So does upper section 32*b* except for a shallow counterbore 32*d* at the upper termination of section 32*b*. The radially inner edge of the counterbore is slightly chamfered. Step 32*c* has an internal shoulder joining the I.D.'s of the two sections 32*a* and 32*b* and a frustoconical tapered external surface joining the O.D.'s of the two sections. The radially inner edge of the internal shoulder of step 32*c*** also has a slight chamfer.

Shell 32 can be assembled onto the fuel injector after the valve group and the power group have been joined together, but before O-ring 44 is placed in its groove around the outside of valve body 30 proximate the nozzle. Shell 32 is coaxially aligned with the nozzle end of the fuel injector and the two are relatively moved together until the shell assumes a position as shown by FIG. 1. The shell is retained in place without any separate fasteners, as by a press-fit or a snap-fit, to one of parts 28 and 30. For example the I.D. of upper section **32*b* may be pressed onto the O.D. of part 28. After the shell has been properly located, assembly of O-ring 44 onto valve body 30 captures the shell on the fuel injector. The lower termination of the shell is at the upper edge of the groove that receives O-ring 44 while the upper termination is proximate the lower termination of overmold cover 36. The lower termination of cover 36 is shaped with an external groove 36*a* for complementary fit with the upper termination of shell 32 such that the two mutually axially overlap while their respective O.D.'s are substantially equal so that on the exterior the shell is substantially flush with cover 36 at the overlap. When tolerance stack-ups in the mass production fabrication of such a fuel injector are taken into account, proper axial dimensioning of the two parts 32, 36 at the overlap joint provides superior concealment of the underlying bare metal in comparison to a joint where no such overlap is provided, concurrent with assuring that the shell 32 is properly located for retention purposes. In other words, the overlap joint greatly minimizes, or eliminates entirely, the possibilities that underlying bare metal will been seen through a gap between the two parts 32, 36 and that the two parts will abut prematurely while being assembled together, thereby preventing shell 32** from becoming properly located and retained on the fuel injector.

Shell 32 can be fabricated from conventional plastic materials using conventional manufacturing processes. The plastic is opaque so as to provide the desired concealment of the underlying bare metal, and it may be colored in any particular color for aesthetic or part-identifying purposes. It can be seen that from its overlap joint with overmold cover 36, shell 32 extends axially to cover the circular flange **30*f* of valve body 30 that forms the upper sidewall of the groove for O-ring ,44**, and since the O-ring has a close axial fit in this groove, the shell extends very close to the O-ring, but it does not interfere with the sealing action of the O-ring when the fuel injector is installed on an engine.

Figure 2:
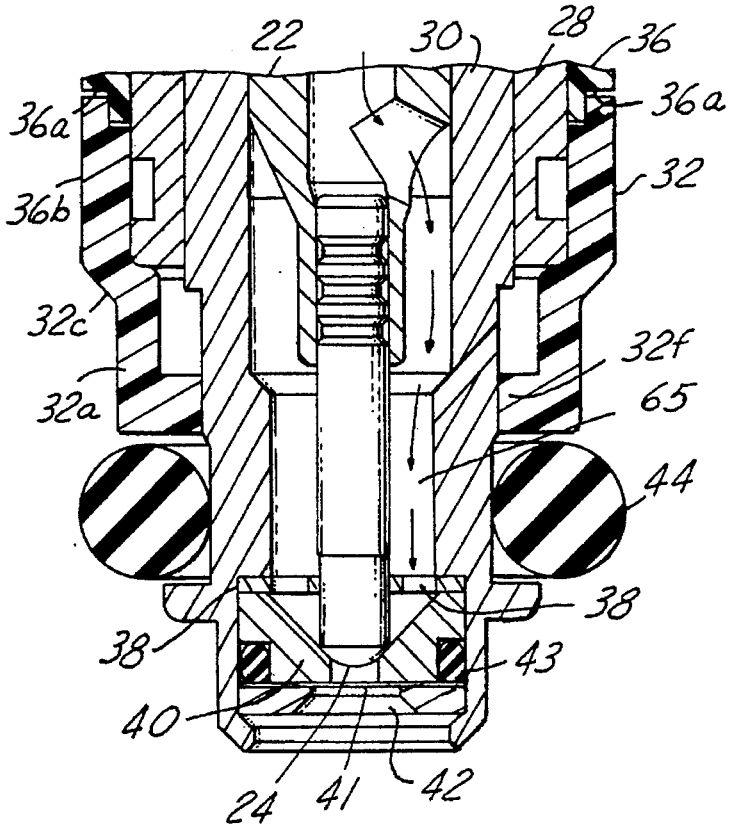
FIGS. 2 and 3 are fragmentary longitudinal cross-sectional views illustrating respective modified forms on an enlarged scale from that of FIG. 1.

FIG. 2 shows an alternate form where shell 32 has a radially inwardly directed flange **32*f* at its lower end that takes the place of the circular flange 30*f* on body 30 that otherwise forms the upper sidewall of the groove for O-ring 44. In this embodiment, shell 32** alone forms the upper side of the groove for the O-ring.

Figure 3:
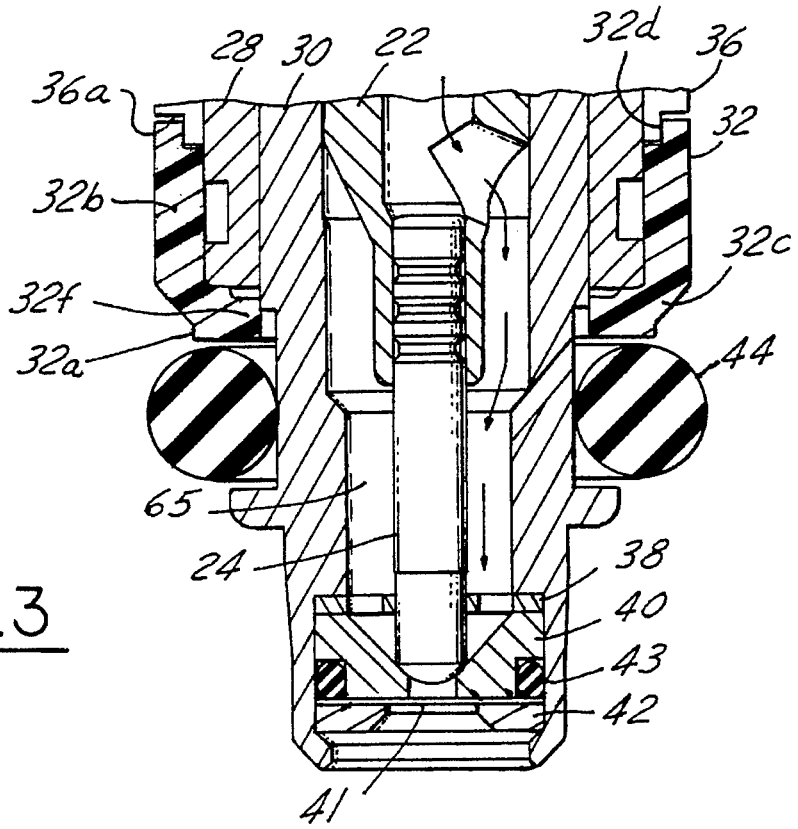

FIG. 3 shows another form where O-ring 44 is disposed further away from the end of the nozzle. This necessitates a shortening in the axial dimension of lower section **32*a*, but the lower termination of the shell has the radially inwardly directed flange 32*f* that alone forms the upper side of the groove for O-ring 44**.

While a presently preferred embodiment of the invention has been illustrated and described, it is to be appreciated that principles of the invention apply to all equivalent constructions and methods that fall within the scope of the following claims.

What is claimed is:

1. An electrically operated fuel injector for injecting fuel into an internal combustion engine having a fuel inlet, a nozzle having a valve seat via which fuel is injected into an engine from the injector, an internal passage within the injector for conveying fuel that has entered the fuel inlet to the nozzle, a metallic valve body structure of the injector that contains the nozzle and at least a portion of the internal passage, a mechanism, with an electrical acutator and a valve, for selectively opening and closing the valve seat in accordance with selective energizing of the electrical actuator, an annular seal disposed around the metallic valve body structure proximate the nozzle, a non-metallic cover on the fuel injector having a sidewall extending axially in covering relation to the acturator and to a portion of the metallic valve body structure spaced from the annular seal such that an axial section of the metallic valve body structure between the annular seal and the non-metallic cover is exposed metal, comprising:

a non-metallic cylindrical shell is fitted onto the metallic valve body structure in covering relation to conceal substantially all of the exposed metal from view, said shell and the sidewall of the non-metallic cover come together in a mutually overlapping joint wherein a portion of said shell and a portion of the cover mutually axially overlap.

2. A fuel injector as set forth in claim 1 wherein the annular seal is an O-ring seal, and the valve body structure comprises a flange that forms an upper sidewall of a groove for the O-ring seal, and said shell has an axial termination disposed substantially even with said groove.

3. A fuel injector as set forth in claim 1 wherein the annular seal is an O-ring seal, and the shell comprises an axial termination that includes a radially inwardly directed flange that alone forms an upper sidewall for a groove for said O-ring seal.

4. A fuel injector as forth in claim 1 wherein an axial section of said shell that is proximate said sidewall of said non-metallic cover is diametrically enlarged relative to an axial section of said shell that is proximate said O-ring seal.

5. A fuel injector as set forth in claim 1 wherein said portion of said shell is disposed radially outwardly of said portion of the cover.

6. A fuel injector as set forth in claim 5 wherein said mutually overlapping portions are constructed and arranged such that said shell and the cover have flush exteriors wherein they come together.

7. A fuel injector as set forth in claim 1 wherein said portion of said shell has an external groove and said portion of the cover has a complimentary external groove at the end of the sidewall.

* * * * *